US006377604B1

(12) United States Patent
Rodriguez

(10) Patent No.: US 6,377,604 B1
(45) Date of Patent: Apr. 23, 2002

(54) CURRENT-CONDUCTING ARM FOR AN ELECTRIC ARC FURNACE

(75) Inventor: Gregory Thomas Rodriguez, Trussville, AL (US)

(73) Assignee: Dixie Arc, Inc., Birmington, AL (US)

( * ) Notice: Subject to any disclaimer, the term of this patent is extended or adjusted under 35 U.S.C. 154(b) by 0 days.

(21) Appl. No.: 09/711,367

(22) Filed: Nov. 9, 2000

(51) Int. Cl.[7] ..... H05B 7/10
(52) U.S. Cl. ..... 373/94; 373/100; 373/101
(58) Field of Search ..... 373/94, 100, 101, 373/92, 51, 52, 95

(56) References Cited

U.S. PATENT DOCUMENTS

| | | | | |
|---|---|---|---|---|
| 4,422,172 A | * | 12/1983 | Dunn et al. | 373/94 |
| 4,589,119 A | * | 5/1986 | Dunn et al. | 373/94 |
| 4,653,066 A | * | 3/1987 | Phillips | 373/94 |
| 4,682,341 A | | 7/1987 | Ehle et al. | 373/99 |
| 5,200,974 A | | 4/1993 | Kark et al. | 373/94 |
| 5,596,598 A | | 1/1997 | Delahalle et al. | 373/93 |
| 5,638,398 A | | 6/1997 | Ikitsu et al. | 373/92 |
| 5,757,841 A | | 5/1998 | Ikitsu et al. | 373/92 |
| 5,905,754 A | | 5/1999 | Dratner et al. | 373/100 |

OTHER PUBLICATIONS

Flohe GmbH & Co, Postfach 30 08 26, D–44560 Castrop–Rauzel, Germany Catalogue No. 3, Year 1998, p. 10.

* cited by examiner

*Primary Examiner*—Tu Ba Hoang
(74) *Attorney, Agent, or Firm*—Christopher A. Holland; Robert J. Veal; Burr & Forman LLP

(57) ABSTRACT

A current-conducting arm for conducting a current from at least one cable supports to an electrode in an electric arc furnace comprising an arm housing having a U-shaped base channel member and a U-shaped top channel member. Both channel members have a first and second wall, with the top channel member being inverted such that the first wall of the top channel member can be joined with the first wall of the base channel member, and the second wall of the top channel member can be joined with the second wall of the base channel member. The arm housing therefore has four annular corners to improve the conduction of current through the arm housing to the electrode. The invention further includes a spring assembly used to provide to aid an electrode holder in clamping the electrode. Moreover, a laser pointer is included for guiding the positioning of the arm housing in the electric arc furnace.

18 Claims, 7 Drawing Sheets

CURRENT-CONDUCTING ARM FOR AN ELECTRIC ARC FURNACE

FIELD OF THE INVENTION

The present invention relates to an improved current-conducting arm for an electric arc furnace, and more specifically, to a design for a current-conducting arm that efficiently conducts current to an electrode being held by the current-conducting arm and that may be assembled and maintained in a simple manner.

BACKGROUND OF THE INVENTION

It is reported that electric arc furnaces produce roughly two-fifths of the steel that is made in the United States. Generally, electric arc furnaces comprise a heating chamber that uses electricity conducted through a current-conducting arm to obtain very high temperatures within the electric arc furnace to melt and alloy metals. Moreover, electric arc furnaces are constructed to purportedly produce almost all the stainless steels, electrical steels, tool steels, and special alloys required by the chemical, automotive, aircraft, machine-tool, transportation, and food-processing industries.

To produce the high temperatures within the furnace, electric arc furnaces use the current-conducting arm to transmit a current to an electrode, which will then generate an arc to melt the desired metal within the furnace by supplying energy to the furnace interior. Electrical energy is supplied from the current-conducting arm to at least one electrode, and the electrode supplies energy to the metal. The purpose of a current-conducting arm is to conduct electrical current from a set of cable connection points to the graphite electrode. As a result, it is important to have the most efficient means available to provide an electric current to the electrode held by the current-conducting arm.

Conventional current-conducting arms (as illustrated in FIG. 1) include a rectangular arm housing 100, an electrode-clamping band 102 or electrode holder, a spring mounted within the arm housing that engages the electrode-clamping band 102, a cylinder mounted within the arm housing, and a series of water cooling pipes that are also mounted within the arm housing to control the temperature within the current-conducting arm. The arm housing of a conventional current-conducting arm is created by welding four rectangular metal plates 104 together at the edge of each plate such that the housing has a rectangular cross-section, as illustrated in FIG. 2. This welded arrangement of the arm housing creates a problem in that there is a high concentration of current in the rectangular corners where the plates 104 are connected together, whereas the remaining surface area of each plate of the arm housing has lower current concentration. In an attempt to solve this problem of high current concentration in the rectangular corners, prior designs applied copper to the corners of the current-conducting arm to aid in the conduction of the current. Nevertheless, in some cases, the current concentration in the corners was so significant in the corners such arms that the copper was stripped from of the corners of the current-conducting arm.

Moreover, each of the weld seams 106 where the plates are welded together provides areas of increased resistance to the conduction of current. Consequently, the current is not conducted through this conventional arm to the electrode with the efficiency that is desired, which will further diminish the efficiency of the melting of the material contained in the furnace.

In addition, the large size of all traditional current-conducting arms provides a problem in the mounting and maintenance of the current-conducting arms in an electric arc furnace. First, improperly aligned current-conducting arms can cause problems with respect to the operation of the electric arc furnace as well as the electrode held by the current-conducting arm. For example, unaligned current-conducting arms can create a weakness in the electrode held by the current-conducting arm. This weakness in the current-conducting arm can further lead to premature deterioration and failure of the electrode held by the current-conducting arm, which requires early replacement of the electrode in the electric arc furnace.

Additionally, conventional current-conducting arms include several components that provide a secure connection for the electrode being held. Such conventional elements include the spring that is connected to a hydraulic cylinder inside the arm to maintain the position of the electrode. The conventional spring is used to pull the electrode towards the arm, with the length of the spring being designed so that the force required to securely engage the electrode is applied. A problem with such a design is that if either the spring or the hydraulic cylinder experiences failure, then the conventional current-conducting arm must be disassembled so that maintenance can be provided for each of the inoperable elements within the current-conducting arm.

What is desired, then, and not found in the prior art, is a current-conducting arm having a design that provides efficient transmission of electrical current, that provides an efficient means for building the arm, and that further reduces maintenance time required to maintain the operability of the arm.

SUMMARY OF THE INVENTION

An object of the present invention is to provide a current-conducting arm for an electric arc furnace having a design promoting the efficient conduction of electric current to an electrode.

A further object of the present invention is to provide a current-conducting arm for an electric arc furnace having an arm housing that may be assembled in a simple fashion along two weld seam lines.

Another object of the present invention is to provide a current-conducting arm for an electric arc furnace that may be maintained in a simple fashion.

An additional object of the present invention is to reduce the area within the arm occupied by a spring that maintains the position of the electrode.

A further object of the present invention is to provide a current-conducting arm for an electric arc furnace that provides a means for precisely mounting the current-conducting arm in the electric arc furnace.

The current-conducting arm of the present invention is designed to hold an electrode within an electric arc furnace. The current-conducting arm of the present invention includes an arm housing that surrounds and protects the various other components of the current-conducting arm, and that is furthermore used to distribute electric current to the electrode. The arm housing includes a base channel member and a top channel member, with both channel members being U-shaped. In assembling the arm housing, the top channel member is inverted such that the edges of the top channel member may be welded to the edges of the base channel member, such that the base channel member is the mirror-image of the top channel member. Consequently, this current-conducting arm may be produced with relative ease, and the design of the arm housing reduces the number of weld seams from conventional current-conducting arms.

The current-conducting arm also includes a spring assembly and a hydraulic cylinder that are encased in the arm housing. The spring assembly includes at least two springs that are positioned between a spring casing and a rear plate. The spring assembly is used to maintain a return force on the electrode to draw the electrode toward the current-conducting arm as with a conventional spring, while reducing the space required inside the arm for the spring assembly. Moreover, the present current-conducting arm includes a spring access cavity that provides convenient access to the spring assembly by the user to reduce the difficulty in maintenance of the current-conducting arm. As a result, the user is able to easily replace the spring assembly as required.

A series of bolt members are also included in the present invention to secure the position of the current-conducting arm with respect to the electric arc furnace. Access to the bolt members is provided through a set of cavities that are provided in the top channel member, which again improves the conditions for maintenance of the arm.

These and other objects and advantages of the invention will become apparent from the following detailed description of the preferred embodiment of the invention

BRIEF DESCRIPTION OF THE DRAWINGS

A current-conducting arm embodying the features of the present invention is depicted in the accompanying drawings which form a portion of this disclosure and wherein.

DESCRIPTION OF THE PREFERRED EMBODIMENTS

Figure 3:
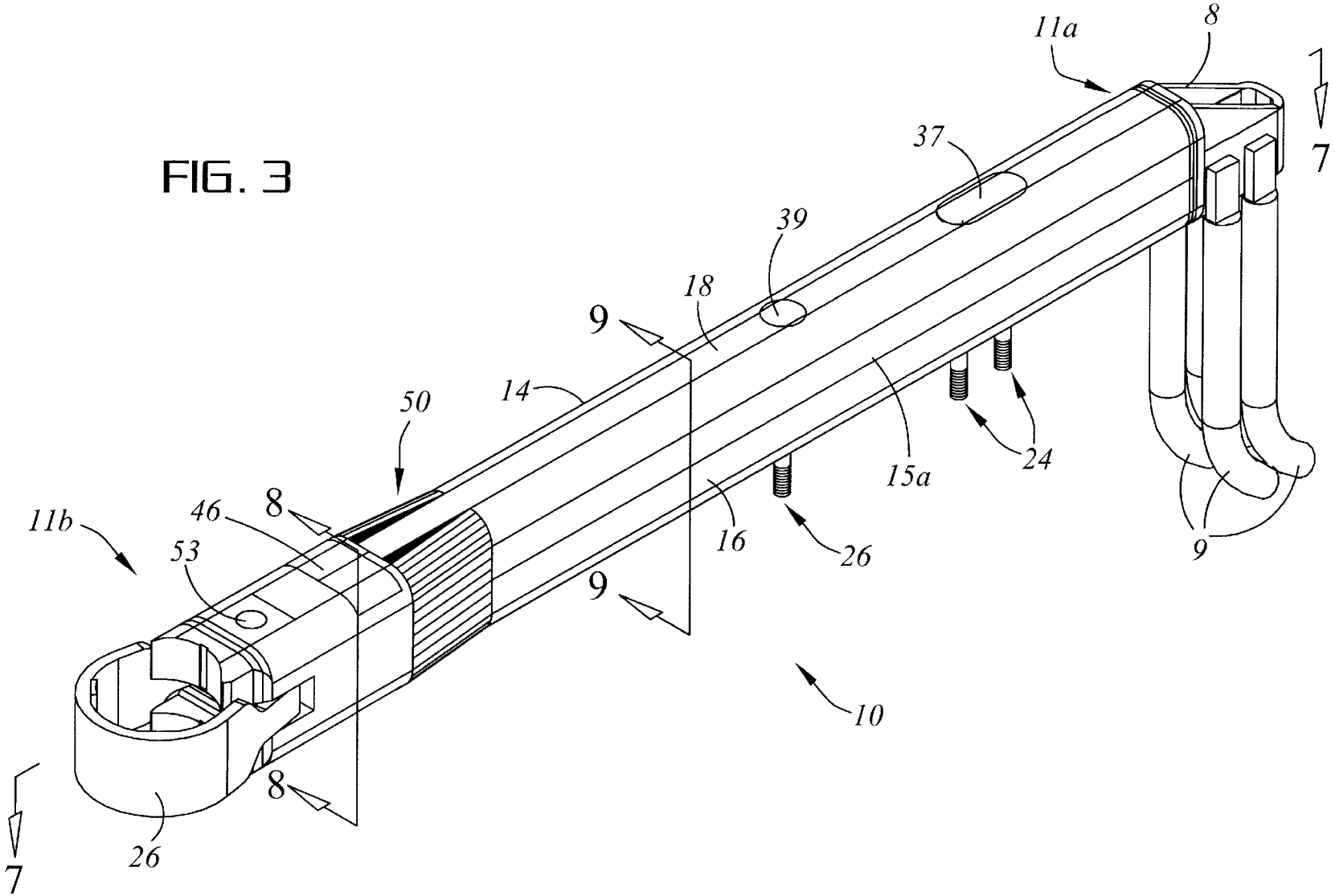
FIG. 3 is a perspective view of the current-conducting arm of the present invention.
Figure 4:
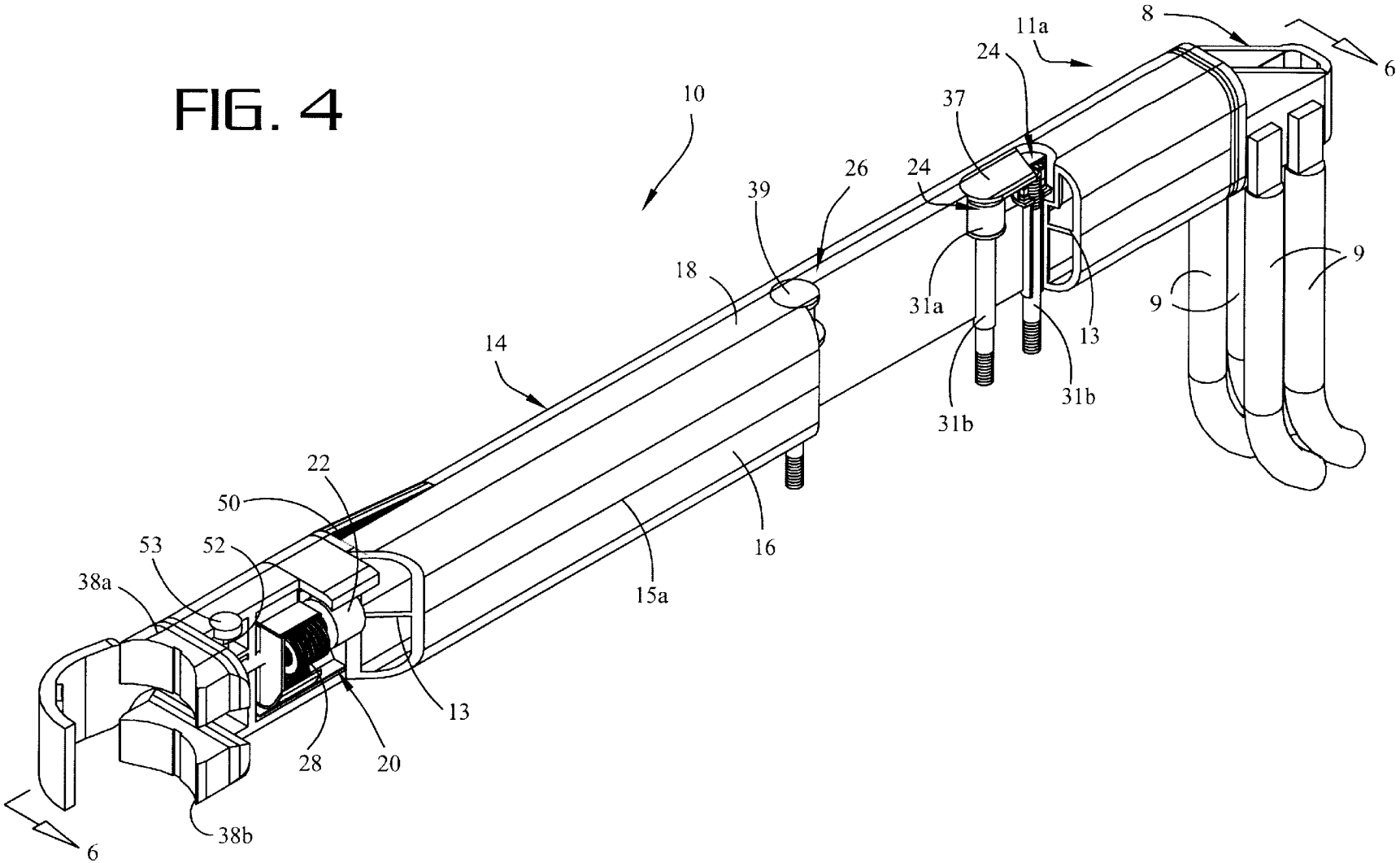
FIG. 4 is a partial sectional perspective view of the current-conducting arm of the present invention.
Figure 5:
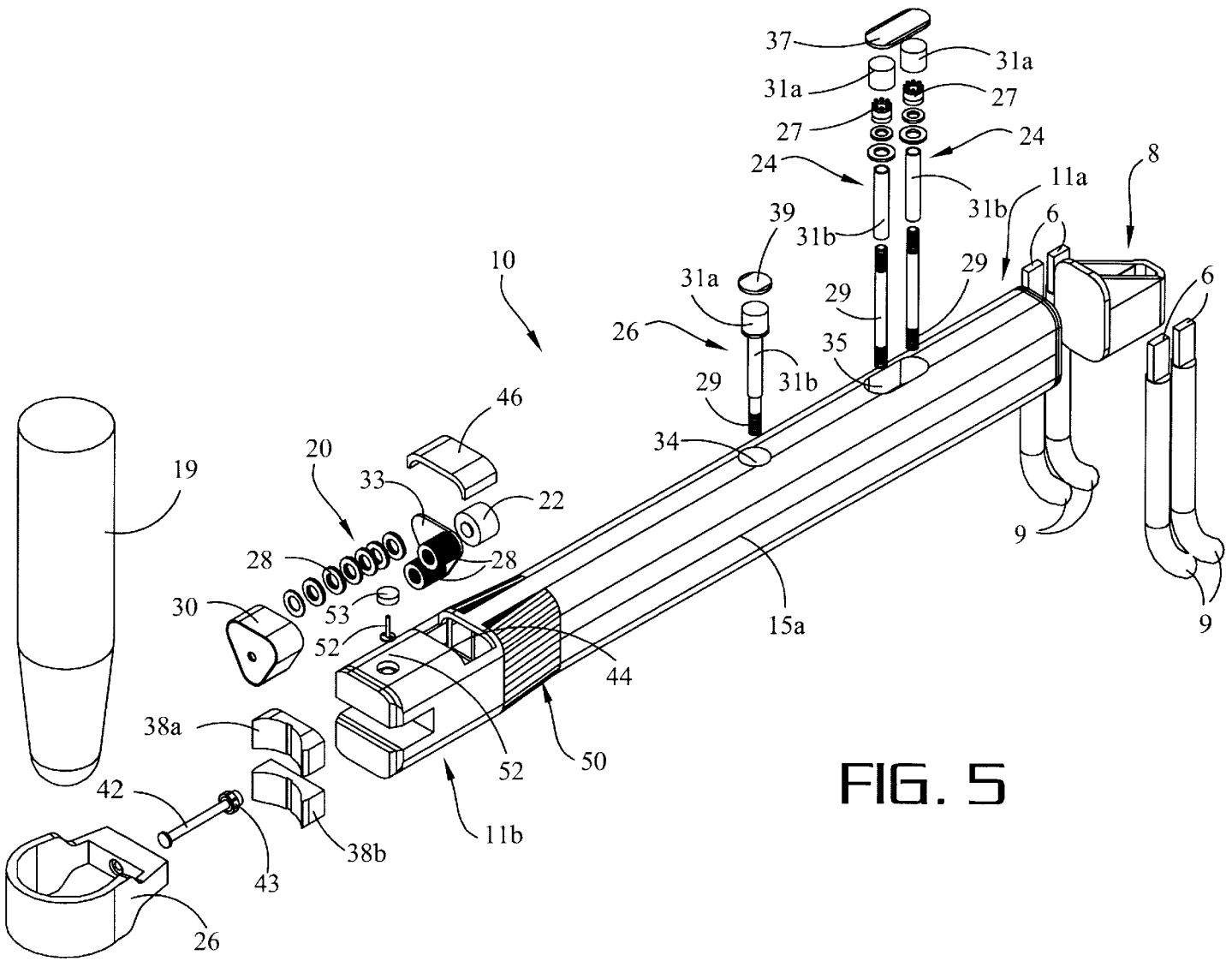
FIG. 5 is a an exploded perspective view of the current-conducting arm of the present invention.

Looking now to FIGS. 3–5, the current-conducting arm 10 of the present invention is illustrated. As with the prior art, the present current-conducting arm 10 is designed to s hold an electrode 19 within an electric arc furnace (not illustrated). The current-conducting arm 10 has a proximal end 11*a* and a distal end 11*b*, with the proximal end 11*a* engaging a rear cable support member 8 and with the distal end 11*b* engaging an electrode holder 26. A plurality of cable support conduits 9 are connected to the rear cable support member 8 via connecting blocks 6, with the cable support conduits 9 providing the electric current to the current-conducting arm 10. The electrode holder 26 is attached to the current-conducting arm 10 to support the electrode 19 within the electric arc furnace. The current-conducting arm 10 is designed to generate heat in the furnace by generating an arc through the electrode 19 that is positioned above the surface of the material in the electric arc furnace (commonly a metal) that is to be heated using the electrode 19. This process will therefore melt the material so that the material may be poured or molded as desired by the user.

The current-conducting arm 10 of the present invention includes an arm housing 14 that surrounds and protects the various other components of the current-conducting arm 10, and that furthermore is used to conduct the electric current to the electrode from 20 the cable support conduits 9. Looking at FIGS. 4 and 9, the arm housing 14 comprises a base channel member 16 and top channel member 18. Both the base channel member 16 and the top channel member 18 are U-shaped channels such that the base channel member 16 has a first and second wall 23*a*, 23*b* and the top channel member 18 also has a first and second wall 21*a*, 21*b*. The top channel member 18 is inverted with respect to the base channel member 16 such that the first and second walls 23*a*, 23*b* of the base channel member 16 and the first and second walls 21*a*, 21*b* of the top channel member 18 may be welded together. The base channel member 16 is welded to the top channel member 18 to create the desired symmetrical arm housing 14, such that the top channel member 18 is the mirror-image of the base channel member 16.

Figure 1:
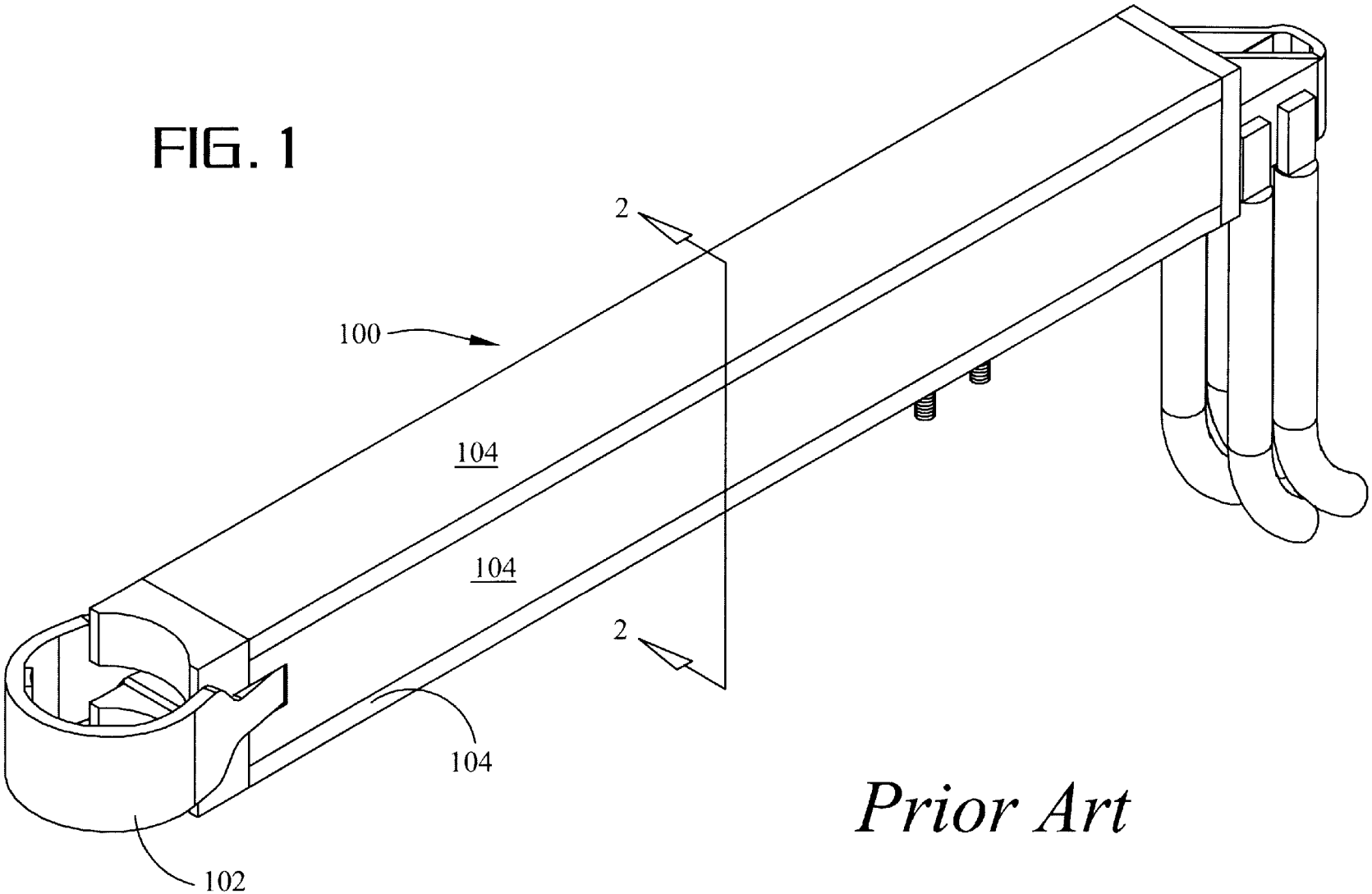
FIG. 1 Prior Art
FIG. 1 is a perspective view of a current-conducting arm of the prior art.
Figure 9:
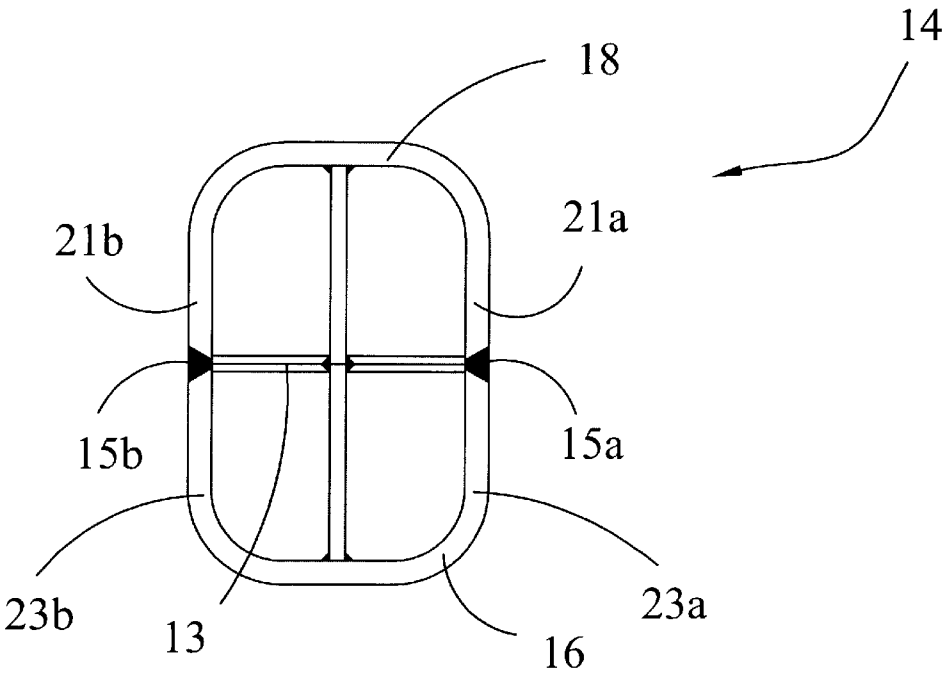
FIG. 9 is a sectional view of the current-conducting arm taken along lines 9—9 of FIG. 3.

This design for the current-conducting arm 10 provides several benefits. First, compared to conventional current-conducting arm designs as illustrated in FIG. 1, the current-conducting arm 10 of the present invention is easier to manufacturer. In particular, there are only four edges that need to be welded together with the current-conducting arm 10 of the present invention, forming two weld seams 15*a*, 15*b* as illustrated in FIGS. 4 and 9. In contrast, looking at FIGS. I and 2, conventional current-conducting arms have four plates 104 with eight edges that must be welded together, thereby producing four weld seams 106 as described above.

Figure 2:
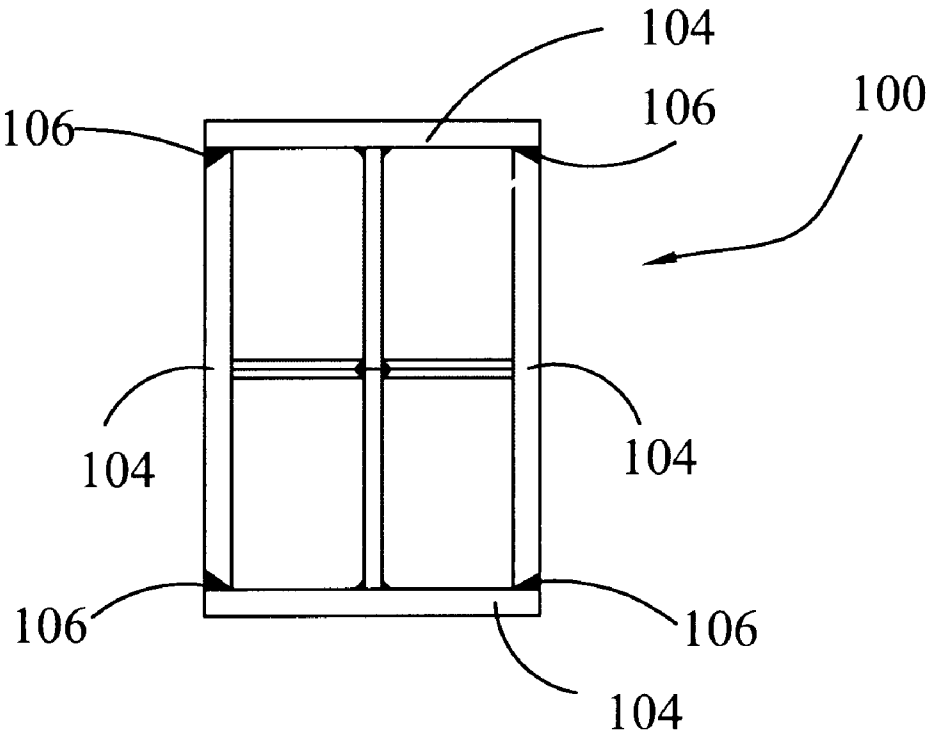
FIG. 2 Prior Art
FIG. 2 is a sectional view of the current-conducting arm of the prior art as illustrated in FIG. 1, with the view taken along lines 2—2.

Moreover, since there are only two weld seams 15*a*, 15*b* in the present current-conducting arm 10, as opposed to the four weld seams that are provided at the corners of the conventional arm housing illustrated in FIG. 2, the current conducting properties of the present current-conducting arm 10 are improved. Each weld seam 15*a*, 15*b* in a current-conducting arm will increase resistance to the flow of electric current through the current-conducting arm to the electrode. Consequently, since each weld seam 15*a*, 15*b* in the present current-conducting arm 10 will provide an additional resistance and lower conductivity, the reduction in the number of weld seams 15*a*, 15*b* in the present current-conducting arm 10 improves the conductivity of the current-conducting arm 10. As a result, this design lowers the reactance to improve the efficiency of the conduction of current to the electrode to further improve the effectiveness in melting the desired material contained within the electric arc furnace.

Additionally, as stated above, research has shown that a high concentration of current is developed in the rectangular corners of conventional rectangular current-conducting arms 100 as shown in FIG. 2. The high concentration of current is developed where the plates are connected together, while the remaining surface area of each plate of the arm housing has lower current concentration of current. With the design of the present current-conducting arm 10, both the base channel member 16 and the top channel member 18 are U-shaped, such that the corners of the current-conducting arm 10 are annular. As a result, there are no rectangular corners defined in the arm housing 14, such that the current flowing through the current-conducting arm 10 does not concentrate in one area, such as the rectangular corners. Put another way, there are no rectangular corners in the present current-conducting arm 10 that would create a high current concentration as with prior art designs.

Figure 6:
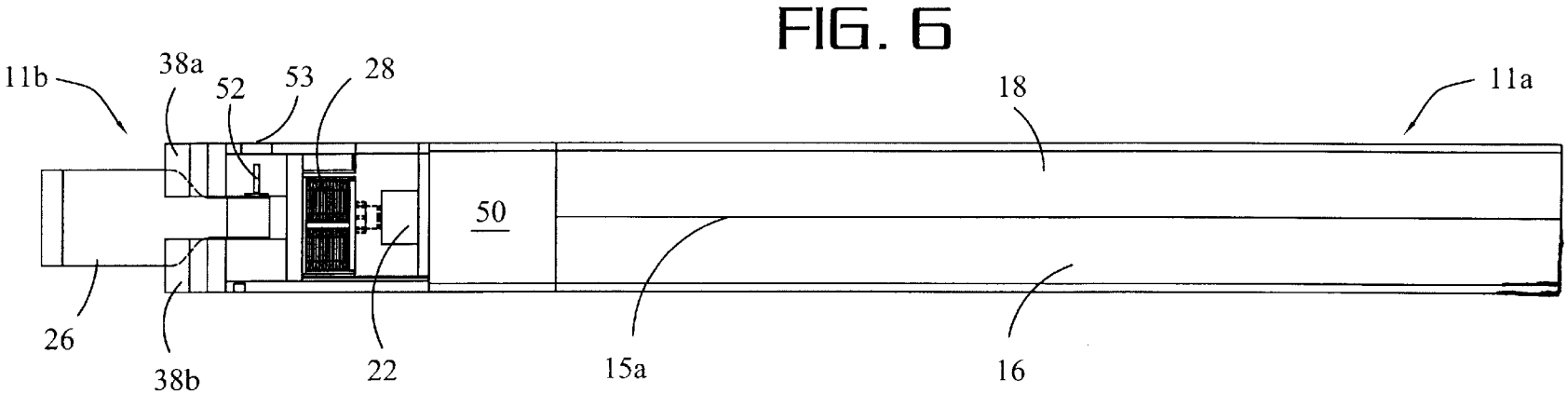
FIG. 6 is a sectional side view of the current-conducting arm of the present invention taken along lines 6—6 of FIG. 4.
Figure 7:
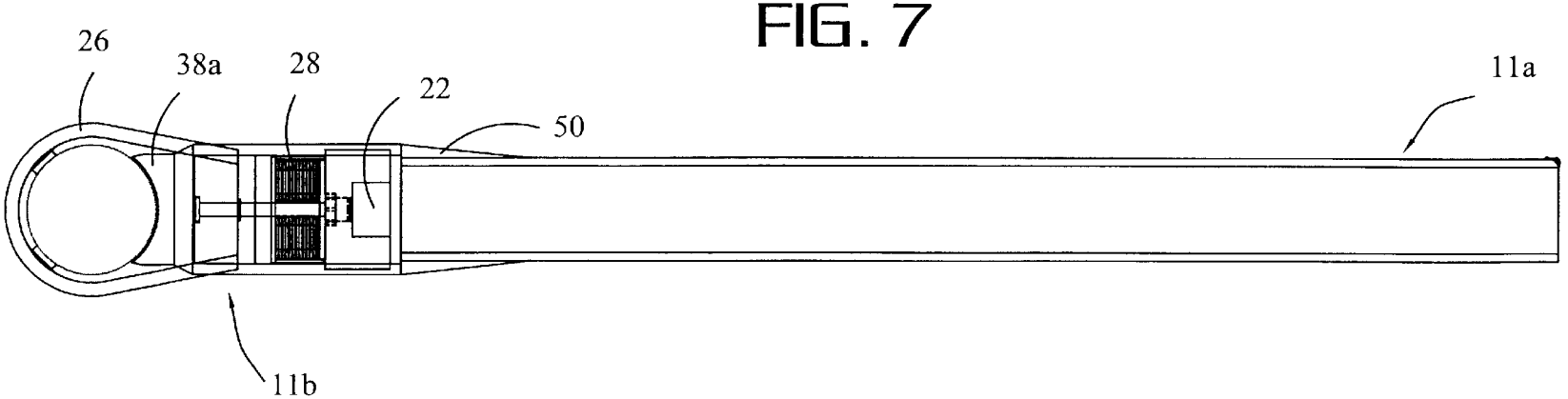
FIG. 7 is a sectional top plan view of the current-conducting arm of the present invention taken along lines 7—7 of FIG. 3.

Looking to FIGS. 4, 5, and 6, a series of bolt members, preferably two proximal bolt members 24 and one distal bolt member 26, are used to secure the position of the current-conducting arm 10 with respect to the electric arc furnace. The proximal bolt members 24 and the distal bolt member 26 each have a design that is conventional in the industry; that is, each bolt member 24, 26 has a head member 27 and a threaded body member 29, with the head member 27 being surrounded by an insulation cover 31*a* and the body member 29 being surrounded by an insulation cover 31*b* to reduce conduction of electrical current through each bolt member 24, 26. The proximal and distal bolt members 24, 26 are operable to engage the base channel member 16 of the arm housing 14 to secure the arm housing 14 to a foundation (not illustrated) either within or immediately outside of the electric arc furnace.

Looking at FIG. 6, the top channel member 18 of the arm housing 14 includes a proximal bolt member cavity 34 and a distal bolt member cavity 35 that provides access to the primary and distal bolt members 24, 26. The proximal and distal bolt member cavities 34, 35 provide access to the proximal and distal bolt members 24, 26 such that the user is able to assemble and provide maintenance for the various components of the arm housing 14. In addition, the present design includes a proximal bolt member cover 37 and a distal bolt member cover 39. The proximal bolt member cover 37 and the distal bolt member cover 39 each engage the arm housing 14 to cover the respective proximal and distal bolt member cavities 34, 35. Consequently, both bolt covers 37, 39 protect the inside area of the arm housing 14 by reducing potential for entry of any undesired external debris through either the proximal or distal bolt cavities 34, 35. Additionally, both bolt covers 37, 39 are made of the same material as the rest of the arm housing 14 such that they will conduct current with the arm housing 14.

Figure 8:
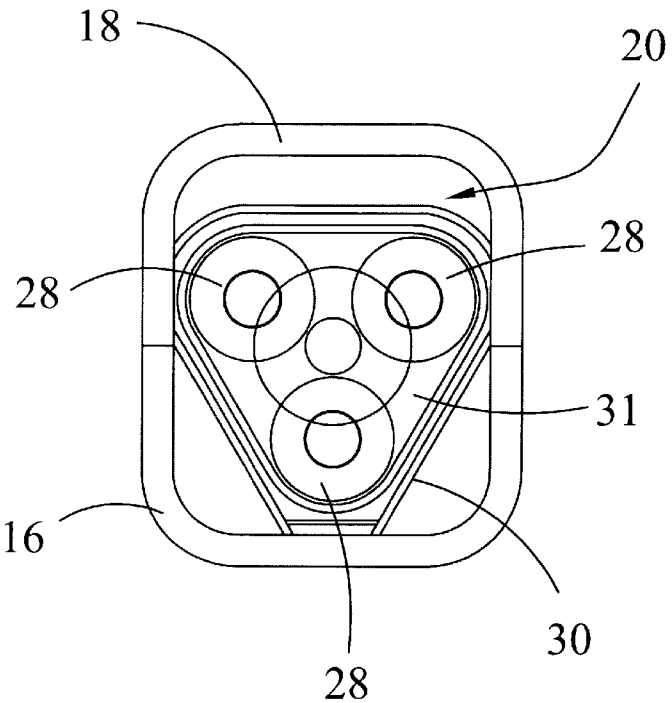
FIG. 8 is a sectional view of the current-conducting arm taken along lines 8—8 of FIG. 3.

Looking at FIGS. 4, 5 and 8, the current-conducting arm 10 additionally includes a spring assembly 20 and a hydraulic cylinder 22, both of which are encased in the arm housing 14. The spring assembly 20 of the present invention includes at least two springs 28, with the preferred embodiment including three springs. The springs 28 of the spring assembly 20 are positioned between a spring casing 30 and a rear plate 33. Conventional current-conducting arms utilize a spring design that is made of one row of disc springs that is typically approximately five to six feet long, which consequently requires a substantial amount of space within the current-conducting arm. This conventional spring is mounted in the current-conducting arm to maintain a return force on the electrode to draw the electrode toward the current-conducting arm. In contrast, the spring assembly 20 of the present invention is able to reduce the space occupied by conventional springs within the arm housing 14. By including the multiple springs 28 positioned between the spring casing 30 and the rear plate 33, the spring assembly 20 is able to maintain the same force on the electrode as that provided by the one long spring in the conventional current-conducting arm. Most beneficially, the distance between the rear plate 33 and the front plate of the spring casing 30 is approximately three feet, therefore requiring approximately half of the space occupied in the arm housing 14 with conventional springs, while nonetheless maintaining the desired return force on the electrode. Additionally, while the distal end 11*b* of the current-conducting arm 10 must be wider in order to receive the spring assembly 20, the proximal end 11*a* remains the same width as conventional current-conducting arms so that the present design can be mounted in conventional electric arc furnaces. Looking at FIGS. 3 and 4, a tapered section 50 joins the proximal end 11*a* of the current-conducting arm 10 to the distal end 11*b* of the current-conducting arm 10 to allow the required increase in the width of the distal end 11*b,* while the current-conducting arm 10 may still be mounted in a conventional electric arc furnace.

The arm housing 14 additionally includes a spring access cavity 44 that traverses the arm housing 14 to provide convenient access to the spring assembly 20 by the user. As a result, the user is able to easily engage the spring assembly 20 as required. More specifically, the dimensions of the spring access cavity 44 are such that the spring assembly 20 may easily be removed and installed as necessary. By providing uncomplicated access to the spring assembly 20, the user is saved a substantial amount of time in maintenance, and the costs to repair unexpected problems in the current-conducting arm 10 are reduced since repairs that required hours in conventional current-conducting arm designs take only minutes with the present current-conducting arm 10. Additionally, a spring access hatch 46 is included in the present design such that the user can cover the spring access cavity 44 as desired to protect the elements contained within the arm housing 14. Moreover, the spring access hatch 46 additionally serves as a conductor such that there is not interruption in the conduction of current through the arm housing 14.

The preferred embodiment of the present invention further includes a pair of contact pads 38*a,* 38*b* that are connected to the distal end 11*b* of the current-conducting arm 10. The contact pads 38*a,* 38*b,* which are preferably made of copper, are used to engage and brace the electrode with the electrode holder 26. The electrode holder 26 is attached to the distal end 11*b* of the current-conducting arm 10 via a positioning rod 42. The positioning rod 42 is connected to the electrode holder 26 and extends between the contact pads 38*a*, 38*b* of the distal end 11*b* of the arm housing 14 and further traverses the spring assembly 20 to engage the hydraulic cylinder 22. Therefore, the spring assembly 20 is operable to apply a return force on the electrode holder 26 to pull the electrode holder 26 and the contained electrode toward the current-conducting arm 10. Also, the hydraulic cylinder 22 can be coupled to the positioning rod 42 by the use of a coupling nut 43. This coupling will allow the hydraulic cylinder 22 to be dual acting to both apply pressure to the spring assembly 20 for releasing the electrode and to assist in the clamping of the electrode.

As stated above, it is important that the current-conducting arm 10 be properly mounted within the electric arc furnace. Improper positioning of the current-conducting arm 10 often leads to premature failure of the electrode. Consequently, the present current-conducting arm 10 additionally includes a laser pointer 52 that is mounted in the distal end 11*b* of the arm housing 14, as illustrated in FIG. 5. The laser pointer 52 acts as a guide when the current-conducting arm 10 is mounted within an electric arc furnace. More specifically, the laser pointer 52 is mounted to the upper or lower surface of the current-conducting arm 10 to provide a laser beam that is directed from the distal end 11*b* of the current-conducting arm 10 to a fixed target (not illustrated) such that when the current-conducting arm 10 is being mounted within the electric arc furnace, the user will verify proper alignment of the current-conducting arm 10 as the laser beam from the laser pointer 52 is projected onto the target. Additionally, a laser covering 53 is provided to protect the laser pointer 52 while it is not in use. The laser covering 53 is made of the same material as the arm housing 14 such that it will conduct current as desired.

Thus, although there have been described particular embodiments of the present invention of a new and useful CURRENT-CONDUCTING ARM FOR AN ELECTRIC ARC FURNACE, it is not intended that such references be construed as limitations upon the scope of this invention except as set forth in the following claims.

What is claimed is:

1. An improved current-conducting arm in an electric arc furnace for conducting current from a plurality of support conduits to an electrode, the improved current-conducting arm comprising:

an arm housing having a distal end and a proximal end, said distal end connected to the electrode holder and said proximal end connected to the support conduits;

wherein said arm housing comprises a base channel member having a U-shaped channel with a first wall and a second wall and a top channel member having an inverted U-shaped channel with a first wall and a second wall;

wherein said first wall of said base channel member is connected to said first wall of said top channel member and said second wall of said base channel member is connected to said second wall of said top channel member.

2. The improved current-conducting arm as described in claim 1 further comprising a spring assembly mounted in said distal end of said arm housing, said spring assembly including at least one spring positioned between a spring casing and a rear plate.

3. The improved current-conducting arm as described in claim 2 further comprising a spring access cavity traversing said top channel member, said spring access cavity positioned proximate said spring assembly.

4. The improved current-conducting arm as described in claim 3 further comprising a spring access hatch to engage said arm housing and cover said spring access cavity.

5. The improved current-conducting arm as described in claim 2 further comprising:

an electrode holder surrounding the electrode;

a hydraulic cylinder mounted proximate said spring assembly within said arm housing; and a positioning rod, said positioning rod traversing said spring assembly to connect said hydraulic cylinder with said electrode holder such that said hydraulic cylinder is able to pull and release said electrode holder to secure the electrode between said electrode holder and said arm housing.

6. The improved current-conducting arm as described in claim 1 further comprising at least one bolt member traversing said base channel member to connect said arm housing to the electric arc furnace.

7. The improved current-conducting arm as described in claim 6 further comprising a bolt member cavity traversing said top channel member, said bolt member cavity providing access to said bolt member.

8. The improved current-conducting arm as described in claim 7 further comprising a bolt member cover to engage said arm housing and cover said bolt member cavity.

9. The improved current-conducting arm as described in claim 1 further comprising a laser pointer mounted to said distal end of said arm housing to align said arm housing when being attached mounted in the electric arc furnace.

10. A method for assembling a current-conducting arm for an electric arc furnace comprising the steps of:

providing an arm housing having a base U-shaped channel member having a first wall and a second wall and a top U-shaped channel member having a first wall and a second wall;

inverting said top U-shaped channel member;

positioning said top U-shaped channel member proximate said base channel member such that said first wall of said top U-shaped channel member is proximate said first wall of said base U-shaped channel member and said second wall of said top U-shaped channel member is proximate said second wall of said base U-shaped channel member;

joining said first wall of said top said top U-shaped channel member with said first wall of said base U-shaped channel member; and joining said second wall of said top U-shaped channel member with said second wall of said base U-shaped channel member.

11. A current-conducting arm in an electric arc furnace used to conduct current from at least one cable support conduit to an electrode, said current-conducting arm comprising:

an arm housing having a distal end and a proximal end, wherein the cable support conduit is connected to said proximal end of said arm housing;

an electrode holder positioned proximate said distal end of said arm housing, said electrode holder surrounding the electrode;

a spring assembly mounted in said distal end of said arm housing, said spring assembly including at least two springs positioned between a spring casing and a rear plate;

a hydraulic cylinder mounted proximate said spring assembly within said arm housing; and a positioning rod traversing said spring assembly to connect said hydraulic cylinder with said electrode holder such that said hydraulic cylinder is able to pull and release said electrode holder using said positioning rod to secure the electrode between said electrode holder and said arm housing.

12. The current conducting arm as described in claim 11 wherein said arm housing comprises:

a U-shaped base channel member having a first wall and a second wall; and an inverted U-shaped top channel member having a first wall and a second wall;

wherein said first wall of said base channel member is attached to said first wall of said top channel member and said second wall of said top channel member is attached to said second wall of said base channel member.

13. The current conducting arm as described in claim 12 further comprising a spring access cavity traversing said top channel member, said spring access cavity positioned proximate said spring assembly for access to said spring assembly.

14. The current-conducting arm as described in claim 13 further comprising a spring access hatch to engage said arm housing and cover said spring access cavity.

15. The current-conducting arm as described in claim 12 further comprising at least one bolt member traversing said base channel member to connect said arm housing to the electric arc furnace.

16. The current-conducting arm as described in claim 15 further comprising a bolt member cavity traversing said top channel member, said bolt member cavity providing access to said bolt member.

17. The improved current-conducting arm as described in claim 16 further comprising a bolt member cover to engage said arm housing and cover said bolt member cavity.

18. The improved current-conducting arm as described in claim 11 further comprising a laser pointer mounted to said distal end of said arm housing to align said arm housing when being attached mounted in the electric arc furnace.

* * * * *